United States Patent [19]

Moriyama et al.

[11] Patent Number: 4,891,552

[45] Date of Patent: Jan. 2, 1990

[54] IMAGE DISPLAY APPARATUS WITH MEANS FOR CORRECTING IMAGE DISTORTION

[75] Inventors: Yuichi Moriyama, Ibaraki; Toshinobu Sekihara, Osaka, both of Japan

[73] Assignee: Matsushita Electric Industrial Co., Ltd., Kadoma, Japan

[21] Appl. No.: 195,388

[22] Filed: May 10, 1988

Related U.S. Application Data

[63] Continuation of Ser. No. 864,598, May 19, 1986, abandoned.

[30] Foreign Application Priority Data

May 20, 1985 [JP] Japan ..... 60-107448

[51] Int. Cl.[4] ..... H01J 29/74

[52] U.S. Cl. ..... 313/495; 313/413; 313/432; 313/434; 313/437; 313/439

[58] Field of Search ..... 313/409, 411, 413, 414, 313/421, 422, 426, 429, 432, 434, 437, 439, 495, 497; 315/364, 366

[56] References Cited

U.S. PATENT DOCUMENTS

| | | | |
|---|---|---|---|
| 2,076,086 | 4/1937 | Ladner | 313/434 |
| 2,921,227 | 1/1960 | Mackay | 313/432 |
| 3,551,732 | 12/1970 | Urano | 313/434 X |
| 4,131,823 | 12/1978 | Credelle | 313/422 |
| 4,227,177 | 4/1985 | Watanabe et al. | 313/422 |
| 4,451,852 | 5/1984 | Masuda et al. | 313/422 X |
| 4,525,653 | 6/1985 | Smith | 313/422 |
| 4,642,517 | 1/1987 | Kanehisa | 313/422 |

FOREIGN PATENT DOCUMENTS 60-131742 7/1985 Japan .

*Primary Examiner*—Donald J. Yusko
*Assistant Examiner*—Michael Horabik
*Attorney, Agent, or Firm*—Cushman, Darby & Cushman

[57] ABSTRACT

An image display apparatus for displaying images on a fluorescent screen comprising plural linear cathodes, an electron beam extraction electrode with plural apertures and vertical deflection electrodes which are formed by segments. The respective segments of the vertical deflection electrodes have various shapes, and deflection voltages applied to the respective segments can be varied so that distortion of the displayed images on the fluorescent screen may be corrected.

2 Claims, 5 Drawing Sheets

IMAGE DISPLAY APPARATUS WITH MEANS FOR CORRECTING IMAGE DISTORTION

This is a continuation of application Serial No. 864,598, filed May 19, 1986, which was abandoned upon the filing hereof.

FIELD OF THE INVENTION AND RELATED ART STATEMENT

1. FIELD OF THE INVENTION

The present invention relates generally to an image display apparatus, and more particularly to an image display apparatus having plural linear cathodes wherefrom multi-electron beams are emitted and are deflected by electrostatic vertical deflection electrodes.

2. DESCRIPTION OF THE RELATED ART

An image display apparatus of the above-mentioned type in the prior art is shown in FIG. 7 and FIG. 8.

Linear cathodes 1 are disposed parallel to each other in one end portion of a vacuum enclosure 10 as shown in FIG. 7. A repeller 25 for reflecting electrons emitted from the linear cathodes 1 is disposed between the linear cathodes 1 and a back end of the vacuum enclosure 10. A fluorescent screen 5 is disposed in the opposite end portion of the vacuum enclosure 10 and has an anode 6 on its inside surface. An electron beam extraction electrode 2, which is a planar metal plate having a number of apertures 8 lined up in plural rows, each disposed in front of and adjacent to the linear cathode 1, is provided between the linear cathode 1 and the fluorescent screen 5. Vertical deflection electrodes 13 and 14 are formed by, for example, a metalizing process on the surfaces of substrates 30 made of insulation material, these substrates being disposed between the fluorescent screen 5 and the electron beam extraction electrodes 2 in a manner so as to be parallel to the linear cathode 1 and perpendicular to the electron beam extraction electrode 2. The electron beams 4, ... emitted from the cathode 1 pass through the apertures 8, travel between the vertical deflection electrodes 13 and 14, and finally reach the fluorescent screen 5. The electron beams 4, ... are deflected by an electrostatic field which is formed by the vertical deflection electrodes 13 and 14, which is formed by the deflection voltage applied thereto.

Horizontal deflection electrodes and acceleration electrodes also are disposed between the vertical deflection electrodes 13, 14 and the fluorescent screen 5 in a portion shown by a chain line 20 in FIG. 8. However, detailed construction is not shown in the drawing because those constructions are not important to the present invention.

Theoretically, an image of a horizontal line on the fluorescent screen 5 made by the electron beams 4, ... is expected to be formed a linear line. However, because the vertical deflection electrodes warp, there is voltage drop along the length of the linear cathodes 1,.., and the electron beams 4, ... are not uniformly deflected. As a result, the images on the fluorescent screen 5 are distorted. Mechanical correction of the warped vertical deflection electrodes are difficult, since the warp of the vertical deflection electrodes is found after the assembly of components and subsequent sealing off of the image display apparatus in the vacuum enclosure 10. Hence, the yield rate in fabrication has been poor.

OBJECT AND SUMMARY OF THE INVENTION

An object of the present invention is to provide an image display apparatus wherein a distortion of images formed on a fluorescent screen can be corrected by variation of the voltage applied to respective vertical deflection electrodes which are divided into plural segments.

An image display apparatus in accordance with the present invention comprises:

linear cathodes for emitting electron beams, an electron beam extraction electrode having apertures for extracting electron beams and which is disposed in parallel with to the linear cathodes, a fluorescent screen disposed parallel with to the electron beam extraction electrode, and electrostatic deflection electrodes disposed between the electron beam extraction electrode and the fluorescent screen, each deflection electrode being divided into at least two pieces with at least a piece disposed nearer to the electron beam extraction electrodes and another piece disposed nearer to the fluorescent screen.

Electrostatic fields are formed by the divided vertical deflection electrodes by impressing different voltages to respective segments of the deflection electrodes. Correction of the distorted images due to the distortion of the deflection electrodes can be made for wide angle deflection by selecting the division ratio and the voltage to be applied to the respective segments of the vertical deflection electrodes.

DESCRIPTION OF THE PREFERRED EMBODIMENT

Figure 1:
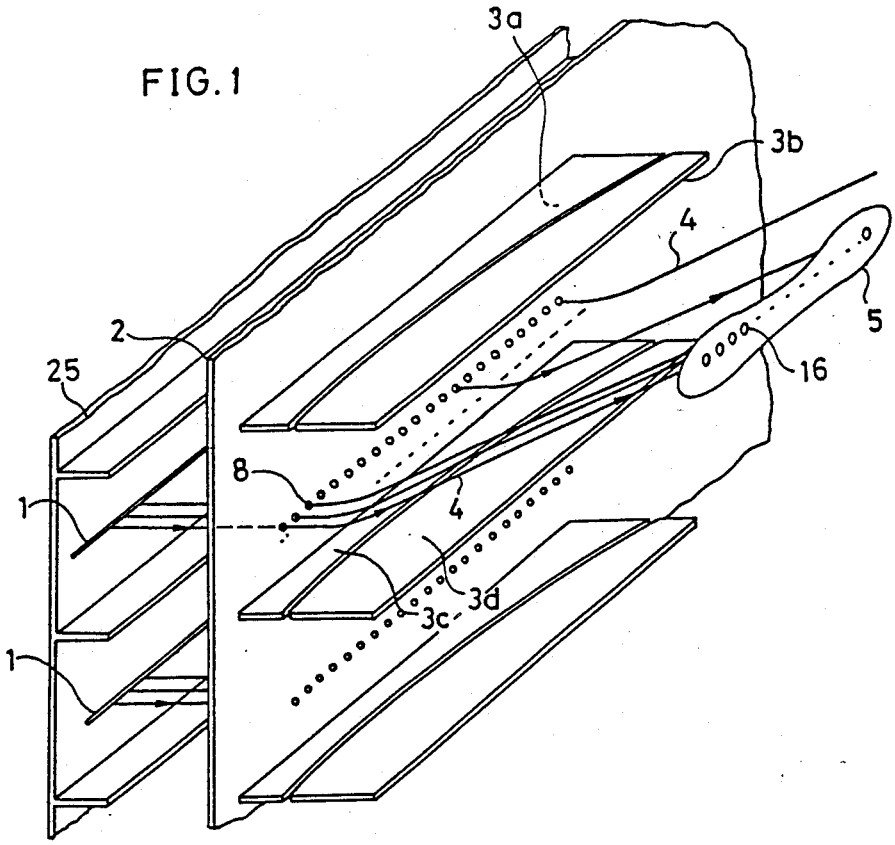
FIG. 1 is a perspective view of an image display apparatus of an embodiment in accordance with the present invention.
Figure 2:
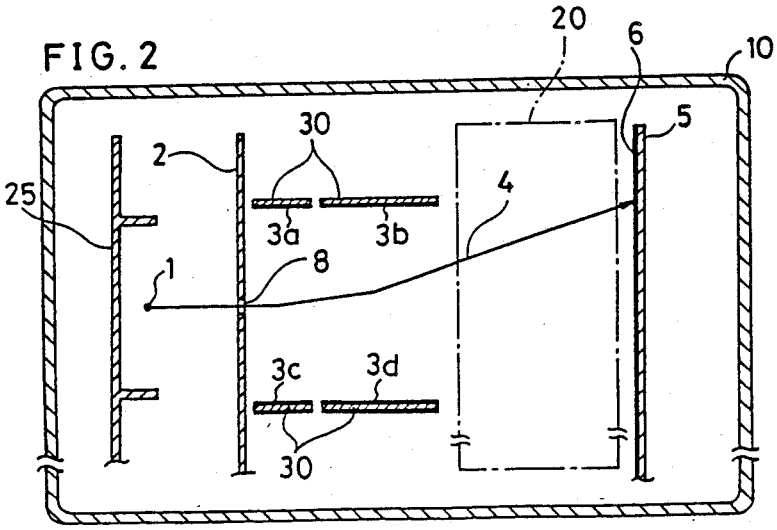
FIG. 2 is a cross-sectional view of the embodiment of FIG. 1.
Figure 7:
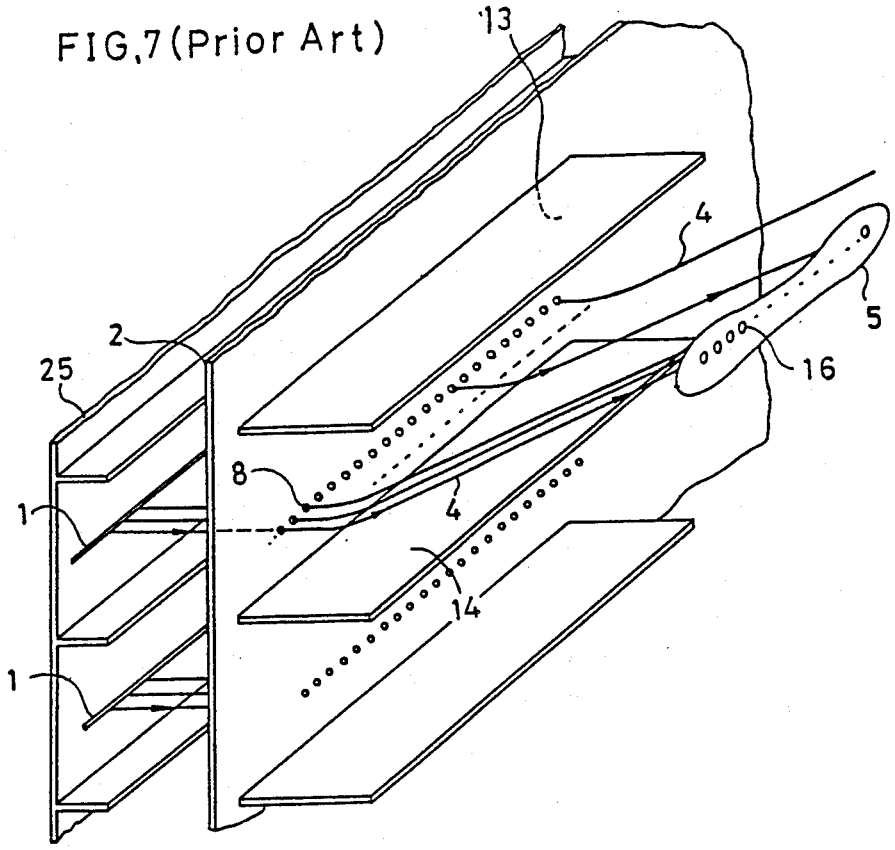
FIG.7 (Prior Art)
FIG. 7 is the perspective view of an image display apparatus in the prior art.
Figure 8:
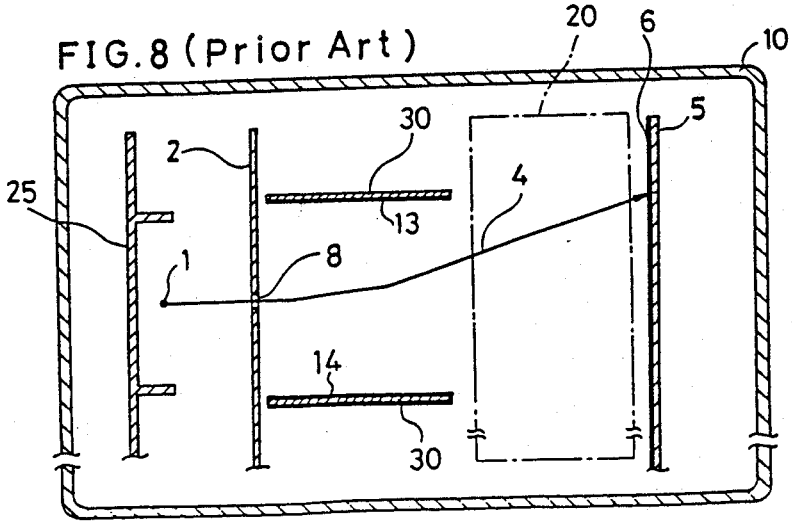
FIG.8 (Prior Art)
FIG. 8 is the cross-sectional view of the image display apparatus of FIG. 7.

An embodiment of an image display apparatus in accordance with the present invention is shown in FIG. 1 and FIG. 2. Linear cathodes 1 are disposed in one end portion of a vacuum enclosure 10 as shown in FIG. 2. Although two linear cathodes are shown in FIG. 1 and FIG. 7, plural linear cathodes, for example 15--60, are used in the practical image display apparatus in accordance with the present invention. The image display apparatus also includes a repeller 25 for reflecting electrons emitted from the linear cathodes 1, the repeller being disposed between the linear cathodes 1 and a back end of the vacuum enclosure 10. A fluorescent screen 5 is disposed in the opposite end portion of the vacuum enclosure 10 and has an anode 6 on its inside surface. An electron beam extraction electrode 2, which is a planar metal plate having a number of apertures 8 lined up in plural rows, each disposed in front of and adjacent to the linear cathode 1, is provided between the linear cathode 1 and the fluorescent screen 5. Vertical deflection electrodes 3*a*, 3*b*, 3*c* and 3*d* formed by, for example, a metalizing process on surfaces of substrates 30 made of insulation material are disposed between the fluorescent screen 5 and the electron beam extraction electrode 2 in a manner parallel to the cathode 1 and perpendicular to the electron beam extraction electrode 2.

A pair of vertical deflection electrodes 3*a* and 3*c* is disposed nearer to the electron extraction electrodes 2 on both sides of each electron beam path passing through the apertures 8. Another pair of vertical deflection electrodes 3*b* and 3*d* is disposed nearer to the fluorescent screen 5 on both sides of each electron beam path passing through the apertures 8. The electron beams 4, . . . from the cathode 1 pass through the apertuers 8, travel between the vertical deflection electrodes 3*a*, 3*b* and the vertical deflection electrodes 3*c*, 3*d*, and finally reach the fluorescent screen 5. The electron beams 4, . . . are deflected by an electrostatic field which is formed by the vertical deflection electrodes 3*a*, 3*b*, 3*c* and 3*d*, which is formed by the deflection voltages applied across the linear cathode 1 and the respective vertical deflection electrodes 3*a*, 3*b*, 3*c* and 3*d*. Four power sources of different voltages for the vertical deflection electrodes 3*a*, 3*b*, 3*c* and 3*d* are provided (not shown in FIG. 1 and 2), so that respective vertical deflection electrodes can be impressed with different voltages with respect to each other.

Figure 3:
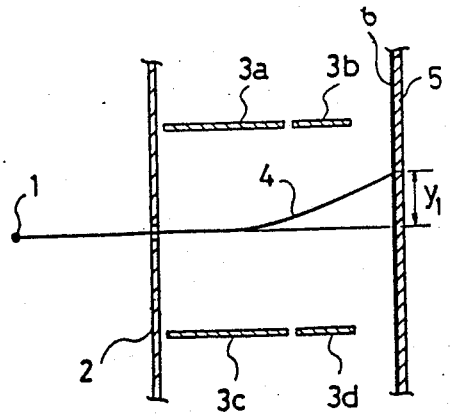
FIG. 3(*a*), FIG. 3(*b*) and FIG. 3(*c*) are cross-sectional views for showing the principle of deflection of an electron beam.
Figure 3:
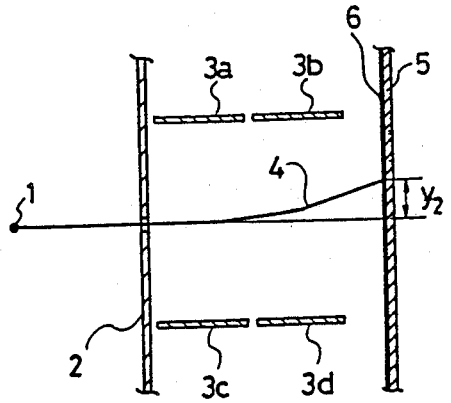
Figure 3:
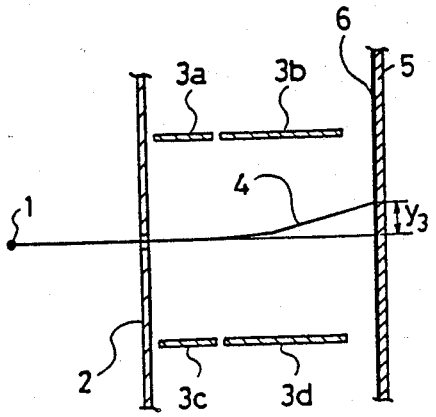
Figure 4:
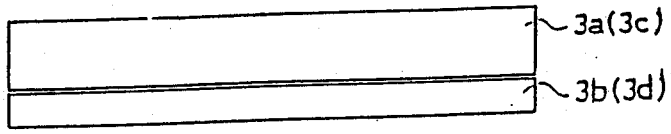
FIG. 4 is a plane view of rectangular vertical deflection electrodes for showing the principle of the present invention.

First, the principle of the present invention is elucidated with reference to FIG. 3(*a*), FIG. 3(*b*), FIG. 3(*c*) and FIG. 4.

The electrons emitted from the linear cathode 1 pass through the plural apertures 8 of the electron beam extraction electrode 2, and rows of electron beams 4, ... are formed. When the electron beams come out of the apertures, at first, they are deflected by an electric field formed by the vertical deflection electrodes 3a and 3*c*. Subsequently, the electron beams are deflected by an electric field formed by the vertical deflection electrodes 3*b* and 3*d*. For example, in the case in which rectangular vertical deflection electrodes 3*a*, 3*c*, 3*b* and 3*d* as shown in FIG. 4 are used, when a voltage applied to the vertical deflection electrode 3*a* is higher than that applied to the electrodes 3*b*, 3*c* and 3*d*, and the vertical deflection electrodes 3*a* and 3*c* are wider than the vertical deflection electrodes 3*b* and 3*d* as shown in FIG. 3(*a*), the electron beam 4 is widely deflected as shown by large deflection value $y_1$. When the vertical deflection electrodes 3*a*, 3*c*, 3*b* and 3*d* have equal widths as shown in FIG. 3(*b*), however, the electron beam 4 is deflected to a medium extent as shown by a medium deflection value $y_2$. Finally, when the vertical deflection electrodes 3*b* and 3*d* are wider than the vertical deflection electrodes 3*a* and 3*c*, the electron beam 4 is deflected to a smallest extent as shown by a small deflection value $y_3$ in FIG. 3(*c*).

Figure 5:
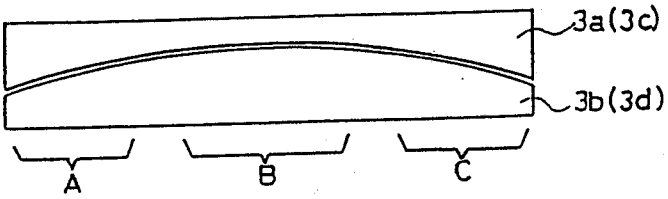
FIG. 5(*a*) and FIG. 5(*b*) are plane views of vertical deflection electrodes embodying the present invention.
Figure 5:
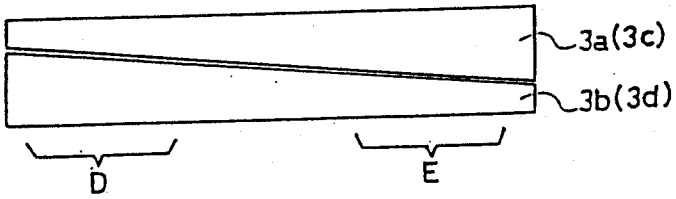

Plane-views of vertical deflection electrodes of embodiments in accordance with the present invention are shown in FIG. 5(*a*) and FIG. 5(*b*). The vertical deflection electrodes 3*a* and 3*b* are formed of concave and convex shapes, respectively, as shown in FIG. 5(*a*). In the embodiment, when a voltage applied to the vertical deflection electrode 3*a* is lower than that applied to the vertical deflection electrode 3*b*, the electron beams which pass the central portion B of the vertical deflection electrodes 3*a* and 3*b* are more deflected than the electron beams which pass the end portions A and C.

Figure 6:
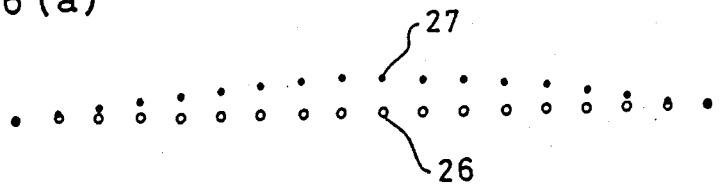
FIG. 6(*a*) and FIG. 6(*b*) are illustrations of images to be represented on a straight line by the electron beams on a fluorescent screen 5.
Figure 6:
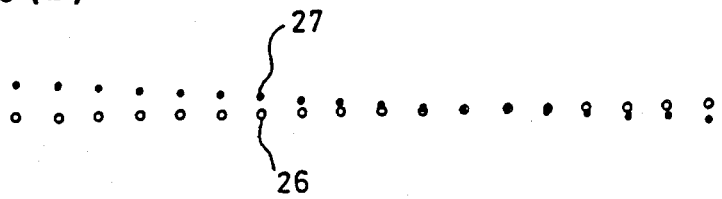

When an image for a straight horizontal line produced by spots 16 made by the electron beams on the fluorescent screen 5 is not linear but is a curve as shown by black dots 27 in FIG. 6(*a*) due to inclination of the initial speeds of the electron beams along the positions of the linear cathode, use of the vertical deflection electrodes 3*a* and 3*b* as shown in FIG. 5(*a*) is recommendable. A deflection voltage (negative) which is larger than that applied to the vertical deflection electrode 3a is applied to the vertical deflection electrode 3*b*. Hence, the electron beams passing the central portion B of the vertical deflection electrodes 3*a* and 3*b* are deflected more than those passing the end portions A and C. As a result, the distortion of the straight line of the images on the fluorescent screen 5 is corrected to be a straight line as shown by small circles 26 in FIG. 6(*a*).

When an image for a straight horizontal line produced by spots 16 made by the electron beams on the fluorescent screen 5 inclines with respect to the straight horizontal line as shown by black dots 27 in FIG. 6(*b*), on the other hand, use of the vertical deflection electrodes 3*a* and 3*b* as shown in FIG. 5(*b*) is recommendable. A deflection voltage (negative) which is larger than that applied to the vertical deflection electrode 3*a* is applied to the vertical deflection electrode 3*b*. Hence, the electron beams passing the left portion D of the vertical deflection electrodes 3*a* and 3*b* are deflected more than those passing the right portion E. As a result, the distortion from the straight line of the images on the fluorescent screen 5 is corrected to a straight line as shown by small circles 26 in FIG. 6(*b*).

What is claimed is:

1. An image display apparatus comprising:

linear cathodes for emitting electron beams, an electron beam extraction electrode having apertures for extracting electron beams, said electron beam extraction electrode being disposed in parallel with said linear cathodes, a fluorescent screen disposed in parallel with said electron beam extraction electrode, and electrostatic deflection electrodes which are composed of at least two pairs of plates, said electrostatic deflection electrodes being disposed between said electron beam extraction electrode and said fluorescent screen, wherein said plates of each electrostatic deflection electrode are isolated from each other and different voltages are applied to each plate, said plates having widths which vary along a direction parallel to electron beam paths between said linear cathodes and said fluorescent screen with respective concave and convex shapes for each plate of said pair of plates.

2. An image display apparatus comprising:

linear cathodes for emitting electron beams, an electron beam extraction electrode having apertures for extracting electron beams, said electron beam extraction electrode being disposed in parallel with said linear cathodes, a fluorescent screen disposed in parallel with said electron beam extraction electrode, and electrostatic deflection electrodes which are composed of at least two pairs of plates and are disposed between said electron beam extraction electrode and said fluorescent screen, wherein respective electrostatic deflection electrode plates vary in width in a direction parallel to electron beam paths between said linear cathodes and said fluorescent screen with substantial arc-shape and are isolated from each other by an arc-shaped separation between respective pairs of plates, different voltages being applied to each electrode plate for varying deflection of said electron beams from said line cathodes so as to correct distortion of images on said fluorescent screen.

* * * * *